United States Patent [19]

Mezak et al.

[11] 4,247,837

[45] Jan. 27, 1981

[54] MULTI-CONDUCTOR FERROMAGNETIC RESONANT COUPLING STRUCTURE

[75] Inventors: John A. Mezak; Ronald A. Parrott, both of San Jose, Calif.

[73] Assignee: Eaton Corporation, Cleveland, Ohio

[21] Appl. No.: 39,907

[22] Filed: May 17, 1979

[51] Int. Cl.[3] ..... H01P 1/217; H01P 1/218; H01P 7/10

[52] U.S. Cl. ..... 333/202; 333/219

[58] Field of Search ..... 333/202–209, 333/1.1, 24.1, 24.2, 24.3, 219

[56] References Cited

U.S. PATENT DOCUMENTS

| | | | |
|---|---|---|---|
| 3,947,782 | 3/1976 | Lohn | 333/204 |
| 4,179,674 | 12/1979 | Keane et al. | 333/207 |

OTHER PUBLICATIONS

Schiefer–"Broadband Circulators for VHF and UHF", Philips Tech. Rev. 36, 1976, No. 9, pp. 255–263.

*Primary Examiner*—Marvin L. Nussbaum
*Attorney, Agent, or Firm*—Kevin Redmond

[57] ABSTRACT

Ferromagnetic resonant devices include special coupling loops formed of multi-conductor transmission lines to increase the RF electromagnetic coupling to the ferromagnetic resonators, while decreasing coupling to spurious resonant modes.

7 Claims, 6 Drawing Figures

A

B

MULTI-CONDUCTOR FERROMAGNETIC RESONANT COUPLING STRUCTURE

BACKGROUND

1. Field

This invention relates to improvements in ferromagnetic filters and, in particular, to a method for increasing the bandwidth while reducing spurious responses in such filters.

2. Prior Art

A ferromagnetic filter in its rudimentary form, consist of a coupling loop positioned close to a sphere of a ferromagnetic material located in a magnetic field. The ferromagnetic material, usually yttrium-iron-garnet (YIG), can be made to produce a principal resonance at a frequency determined by the strength of the magnetic field. The resonant frequency is given by $fo=\gamma Ho$ where Fo is the resonant frequency, $\gamma$ is the gyromagnetic ratio, 2.8 MHz/oersteds, and Ho is the applied magnetic field in gauss.

Bandwidths of such devices are usually small, typically less than 35 MHz about the center frequency. Increasing the bandwidth of these filters has been a long-standing objective. In prior art approaches to produce wider bandwidths, the coupling between the loop and the sphere has been increased by bringing the loop closer to the sphere or a strap with lower inductance has been substituted for the more commonly used single wire loop. These approaches have resulted in an increase in both crossing and tracking spurious responses. Tracking spurious are spurious responses which follow the principal resonance of the sphere as it is tuned across a frequency range. Crossing spurious are those which do not tune at the same rate as the principal resonance mode and therefore cross through the principal resonance mode as it is tuned through a frequency range.

Prior approaches designed to reduce the spurious responses have included decreasing the unloaded Q of the YIG sphere by means of roughening the surface of the sphere; however, this process increases the insertion loss at the principal resonance.

There are a number of additional problems associated with prior art YIG filters which may be explained with reference to a rudimentary YIG filter, such as that shown in FIG. 4. In this Figure, an input port 401 is connected to an output port 402 by way of a coupling loop 403, which surrounds a YIG sphere 404. Note that in all figures, dots on a line about a YIG sphere represent the initiation or termination of a coupling loop. For example, in FIG. 4B, the dots represent the initiation and termination of loop 403. In the operation of this device, a signal placed on the input port is transmitted to the output port. Signals which are at the principal resonance of the sphere are rejected and returned to the input port. In this mode of operation, the device functions as a band-stop filter.

The length of the line from the input port to the output port forms an inductance that is an integral part of the band-stop filter. This inductance limits the range over which the band-stop filter can operate because it functions as a portion of a separate low-pass filter structure. Increasing the inductance reduces the high frequency cutoff of the low-pass filter which, in turn, limits the high frequency response of the YIG filter.

One prior art approach, intended to increase the bandwidth of the YIG filter at its principal resonance, is to lower the external Q of the sphere and loop by increasing the coupling between the two. This is done by increasing the turns of the coupling loops about the sphere. The disadvantage of this approach is it increases the series inductance of the line between the input and output ports and consequently reduces the high frequency cutoff off the low-pass filter section formed by this line.

The desirability of reducing the line inductance in band-stop filters has been generally recognized; however, it has not been as well recognized for bandpass filter. Attempts to reduce the line inductance by again substituting a wide strap for the usual single wire loop has resulted in the increases spurious response described previously. As an alternative to the strap, a number of parallel, closely spaced or touching wires has also been used with similar unsatisfactory results.

Practical prior art ferromagnetic resonator filters, which have been, for the most part, band-pass filters, usually make use of the same components described in connection with the band-stop filter of FIG. 4. That is, they make use of a coupling wire for coupling to the ferromagnetic material, which is typically in the shape of a sphere. The coupling wire is often formed into a loop around the sphere for increased coupling to the sphere. The coupling loops and spheres are housed in a structure which provides RF shielding between stages, but which allows the coupling wires to pass from stage to stage through the shield. A stage, as used herein is a basic filter section comprising for example one YIG sphere and its associated circuitry which is typically one or more coupling loops positioned about the sphere. In FIG. 2, loop 206 positioned about YIG sphere 201 comprise a first stage, loop 207 and sphere 202 comprise a second, and loop 208 and sphere 203 comprise a third.

Interstage coupling is accomplished with a wire with two loops formed along it, both ends of this wire being electrically connected to the RF housing or ground. Input and output coupling is accomplished with a wire loop connected from the input or output transmission line to the RF housing or ground. The coupling loops in each stage are positioned orthogonally with respect to one another to minimize coupling from one loop to another.

It is generally known that a band-pass filter can be designed by using input and output stage external Q and interstage coupling coefficients because the internal Q is relatively high in comparison to the Q of the external circuitry. The coupling values required are available from published tables and are related to the basic filter network. Thus, it is possible to attain the band-pass filter response desired from a ferromagnetic filter by adjusting the coupling loops close to the sphere, or by using a sphere which is large compared to the diameter of the coupling loop. Unfortunately, the spurious problem encountered with band-stop filters is present in band-pass filters as well. Both of these approaches to wide bandwidths lead to increased coupling to spurious modes. The spurious modes are undesirable in a band-pass filter because the tracking spurious modes produce additional passbands which degrades the filter out-of-band rejection and the crossing spurious modes produce additional passband insertion loss. Coupling to these spurious modes can be reduced by decreasing the unloaded Q of the ferromagnetic sphere, but this also causes increased passband insertion loss and a reduction in filter bandwidth. Thus, increased bandwidth in prior art devices results in degraded filter performance.

SUMMARY

In the present invention, spurious responses have been reduced and bandwidth has been increased in YIG filters without increasing loss by means of a multi-conductor loop in which the multi-conductors are separated from one another.

DETAILED DESCRIPTION OF THE INVENTION

Figure 1:
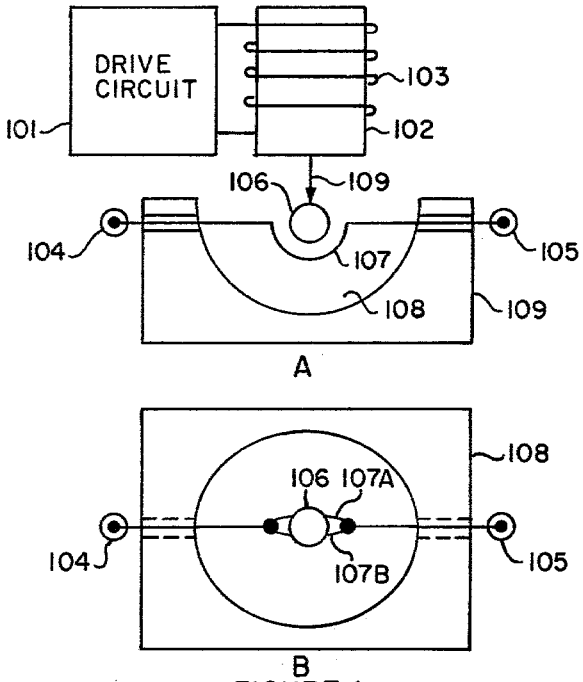
FIG. 1 illustrates a single stage ferromagnetic band-stop filter using a multi-conductor coupling loop.

In the band-stop filter of FIG. 1, a drive circuit 101 supplies a drive signal to a winding 103 located about a core 102, to produce a magnetic field 109 directed to pass through a ferromagnetic sphere 106. An input port 104 is connected to an output port 105, by way of a loop 107 which encircles sphere 106. The sphere and loop are located in a cavity 108 of a frame 109.

FIG. 1A represents a cross sectional view of the side of the band-stop filter, while FIG. 1B represents a top view. It can be seen in FIG. 1B that the coupling loop is divided into two separate conductors, 107A and 107B.

In the operation of the device in FIG. 1, a signal placed on the input port 104 is delivered to the output port 105. Energy at the frequency of the resonant sphere is reflected by the sphere back to the input port, creating a band-stop filter action at the principal resonance frequency of the sphere.

The conductors 107A and 107B are separated by at least the thickness of one of the conductors. The two conductors provide a reduction in the inductance in the line between ports 104 and 105 over a single conductor line, while providing a lower spurious response than is usually encountered with either a strap or a single conductor loop, for the same equivalent coupling bandwidth. The reduced inductance of the multiple conductors produces a lower external Q device and, therefore, increases the bandwidth. With the present invention, bandwidths have been increased by approximately 50 percent over that achieved with prior art devices.

In order to explain the benefit of the invention, the mathematics which describe its operation are introduced below. The external coupling to a YIG shpere is expressed by:

$$Qe = \left[\frac{4r^2\,Ra}{N^2\mu_o Vm(\gamma\mu_o Ms)}\right]\left[1+\left(\frac{\omega_o Ls}{Ra}\right)^2\right] \qquad \text{Equation (1)}$$

Where:

Qe = external Q of the resonator r = radius of the coupling loop in meters

Ra = external load impedance in ohms

N = number of turns $\mu^o$ = permeability of free space, $1.256\times10^{-6}$ henries/meter Vm = volume of the YIG sphere in meters$^3$ $\gamma$ = gyromagnetic ratio, $1.759\times10^{11}$ (MKS units)

Ms = saturation magnetization of the material (MKS units)

$\omega^o$ = resonant frequency of the resonator in radians/second

Ls = self inductance of the coupling loop in henries

The derivation of the above expression is based on the representation of the YIG resonator as an equivalent lumped parallel resonate circuit, formed of conventional inductors and capacitors, separate from the coupling loop inductance. The quantity in the first bracket then represents an equivalent circuit for the YIG resonator. The equivalent circuit values for the inductor and capacitors can be obtained by setting $L_s$ equal to zero in Equation 1.

$$Qe = \omega_o CR_a = \frac{R_a}{\omega_o L} = \frac{4r^2\,Ra}{N^2(\mu_o\gamma M_s)\,\mu_o Vm} \qquad \text{Equation (2)}$$

Figure 5:
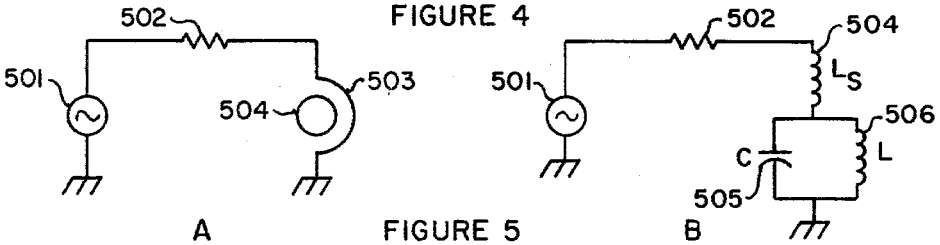
FIG. 5 illustrates an equivalent input or output stage of a band-pass filter.
Figure 6:
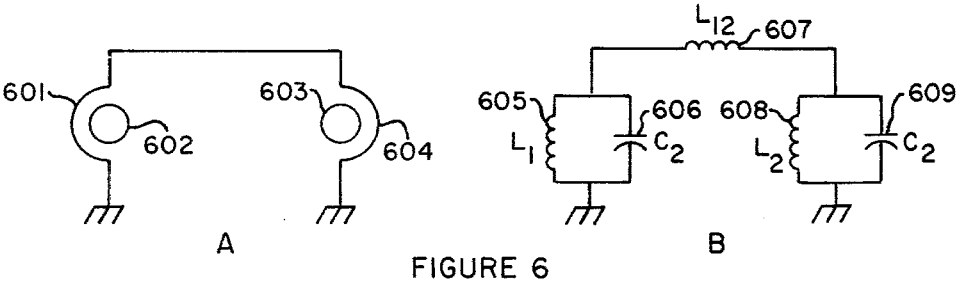
FIG. 6 illustrates an equivalent interstage of a band-pass filter.

An equivalent circuit for an input stage is shown in FIGS. 5A and B, while an equivalent circuit for two YIG resonators coupled by wire loops is shown in FIGS. 6A and B.

The schematic circuit of FIG. 5A comprises a generator 501, a generator source impedance 502, a ferromagnetic sphere 504, and a loop 503 coupled to the ferromagnetic sphere.

FIG. 5B is a lumped element equivalent of the circuit shown in FIG. 5A. This circuit comprises a generator 501, a generator source impedance 502, a self-inductance of the loop 504, an equivalent inductance of the ferromagnetic sphere 506, and an equivalent capacitance of the ferromagnetic sphere 505.

FIG. 6A is a schematic of the interstage coupling of a band-pass filter. This circuit comprises a first loop 601, a first ferromagnetic sphere 602, a second loop 604, and a second ferromagnetic sphere 603.

FIG. 6B is a lumped element equivalent circuit for the circuit of FIG. 6A, wherein inductor 605 and capacitor 606 represent the resonance of sphere 602 and the inductor 608 and capacitor 609 represents the resonant circuit of sphere 604. The inductance 607 represents the combined series inductance of loops 601 and 604.

It can be seen that the equivalent circuit for a YIG band-pass filter is an inductively coupled filter. The coupling between stages of an inductively coupled filter is given by:

$$K_{i,\,i+1} = \frac{\sqrt{L_i L_{i+1}}}{L_{i,\,i+1}}\;\frac{\omega_o}{BW} \qquad \text{Eauation (3)}$$

Where:

$L_{i,\,i+1}$ = coupling inductance between stages i and i+1

$L_i$ = inductance of the inductor in the $i^{th}$ stage $L_{i+1}$ = inductance of the inductor in the $i^{th}+1$ stage BW = bandwidth of the filter in radians/second The inductance $L_{i,\,i+1}$ is the self inductance of the coupling wire. At microwave frequencies this coupling wire has electrical length and its inductance is expressed by:

$$L_{i,i+1}=(Zo/\chi_0)\sin(\beta\lambda) \qquad \text{Equation (4)}$$

Where:

Zo = equivalent characteristic impedance of the coupling wire within the structure chosen $\beta$ = propagation constant in radians/meter $\lambda$ = length of the coupling wire in meters It now becomes apparent that the interstage coupling in a loop coupled YIG filter is highly dependent upon the characteristic impedance and length of the coupling loop. Prior art devices typically use a single 0.003 inch diameter wire in a 0.060 inch diameter cavity, and this structure has a characteristic impedance of approximately 160 ohms. Attempts to increase the coupling in prior art devices consisted of bringing the coupling wire closer to the sphere. This resulted in increased coupling to spurious responses. Since the above mathematical explanation of the parameters involved in the coupling to YIG resonators is not generally available, designs of prior art devices have not made use of all of the coupling parameters involved. In fact, most prior art design practice is based, primarily, upon previous experience of the practitioner and upon an empirical approach, rather than a mathematical or quantitive one. The mathematics presented provides a method for designing the filter input and output couplings, as well as interstage couplings which are required for a particular filter passband response. These equations show the importance of the coupling loop length and characteristic impedance on filter bandwidth.

This invention effectively increases the coupling to YIG resonators by providing a decrease in the characteristic impedance of the coupling structure. This is accomplished through a construction which uses multiple and parallel conductors. These conductors are spread apart, which further reduces the characteristic impedance, but with an accompanying decrease in the coupling to spurious modes compared to close space conductors.

It is now believed that coupling to spurious modes is enhanced by a conductive surface near the YIG sphere, such that an image of the YIG sphere can exist in this conductor. Crossing spurious responses are observed only at the main resonance. That is, they are not excited at frequencies away from the main resonance. It would appear that the main resonance mode couples to the spurious responses, rather than the coupling loop itself coupling directly to the spurious modes. An explanation for this phenomenon is provided by an image surface which allows an image resonator to exist. It is generally known that an additional sphere in a coupling structure will cause coupling to spurious modes. This explains why prior art devices, which use coupling ribbons, straps, large diameter wire, or other large conductors, also have strong coupling to crossing spurious modes.

This invention effectively reduces or eliminates coupling to crossing spurious modes, as well as other spurious modes. The use of multiple conductors spread apart, in effect, breaks up the image plane and reduces the coupling to spurious modes.

The benefit of the invention is apparent in the design and performance of YIG band-pass filters. Prior art devices, using single wire conductors, and doped material to avoid low-level coincidence limiting provide a maximum filter bandwidth of 25 to 4 MHz over a 2 to 18 GHz tuning range. With the present invention, filter bandwidths of greater than 50 MHz are consistently attained, along with reduced spurious responses.

The new invention is also a benefit in the performance of YIG band-stop filters. The coupling to a YIG band-stop filter section is also given by equation 1, but the term Ra becomes equal to twice the system impedance because the coupling loop is in series with the source and load impedance. Since the coupling loop self-inductance is in series with the transmission path, one of the primary design problems is the attainment of a wide impedance match in a band-stop filter. In general, this requires coupling loops with less self-inductance, and a lower characteristic impedance for the coupling loop structure than is used in band-pass filters. Prior art devices typically use a large conductor cross-section, such as relatively large diameter wire, for the coupling loop, but this approach contributes to the coupling to spurious modes, as explained by the image surface concept.

The use of the multiple, and separated, conductor coupling loop structure provides the reduced coupling loop self-inductance required in a band-stop filter along with reduced coupling to spurious responses.

Figure 2:
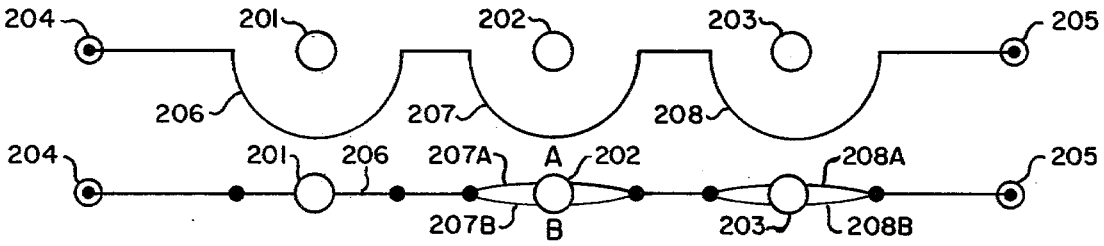
FIG. 2 illustrates a three stage filter using a multi-conductor coupling loop in two of the three stages.
Figure 4:
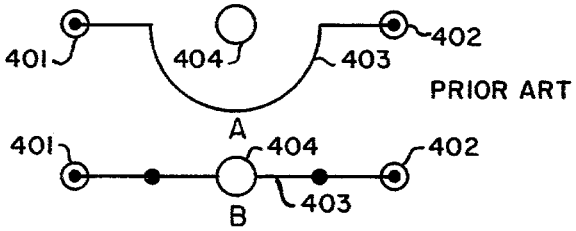
FIG. 4 illustrates a conventional single stage ferromagnetic filter.

FIG. 2 is a drawing of a multistage band-stop filter in which FIG. 2A illustrates a side view of this filter, while FIG. 2B illustrates a top view. In these figures, an input port 204 is coupled to an output port 205 by means of cascaded coupling loops 206, 207, and 208, which encircle ferromagnetic spheres 201, 202, and 203, respectively. It can be seen in FIG. 2B that loop 207 is comprised of conductors 207A and 207B, and coupling loop 208 is comprised of conductors 208A and 208B.

In the operation of this filter, a signal placed on port 204 arrives at port 205, except for power reflected at the resonant frequency of three spheres.

It is possible to combine single solid wire loops with multiple conductor loops, as can be seen in this Figure. The use of different number of conductors in a loop varies the inductance of the loop. This adjustment in the inductance can be used as an aid in varying the impedance of each section as required.

Figure 3:
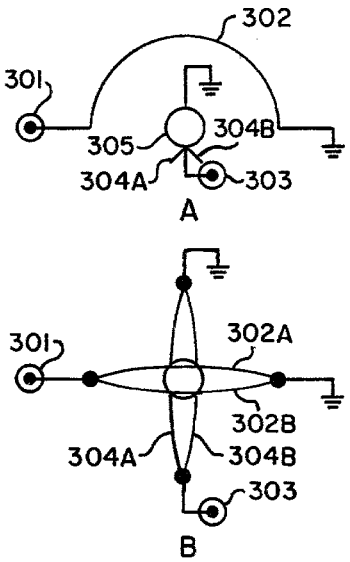
FIG. 3 illustrates a single stage band-pass ferromagnetic filter using multi-conductor coupling loops.

FIG. 3A illustrates a side view of a simple bandpass filter employing the present invention, while FIG. 3B illustrates a top view of this filter. In these Figures, input port 301 is connected to ground by way of loop 302, which encircles YIG sphere 305. Output port 303 is connected to ground by way of loop 304. In FIG. 3B, it can be seen that both loops 304 and 302 each comprise two conductors, A and B, and that loop 302 passes over the top of the sphere, while loop 304 passes beneath the sphere. The two loops are oriented in a generally orthogonal manner. A signal supplied to input port 301 is fed to loop 302 where it is coupled through the sphere at the principal resonance frequency to the output loop 304 and then is fed to the output port 303. Typically two conductor loops are used and the conductors are spaced apart by at least the thickness of one of the conductors. A method for predictably producing the proper spacing in production is to use a strip conductor and by means of photo etching techniques divide the strip into multiple conductors.

Having described the invention, we claim:

1. A ferromagnetic resonant device of the type having a ferromagnetic resonance material subjected to an applied magnetic field and including a line with a loop passing adjacent but not in contact with the ferromagnetic material to couple to said material, characterized in that said loop is comprised of multiple conductors which are spaced apart from one another by at least one conductor diameter, and all of which remain generally parallel to one another.

2. A ferromagnetic filter of the type having a ferromagnetic resonance material subjected to an applied magnetic field and including a line with a loop passing adjacent but not in contact with the ferromagnetic material to couple to said material, characterized in that said loop is comprised of multiple conductors which are spaced apart from one another by at least one conductor thickness, and all of which remain generally parallel to one another.

3. A filter as claimed in claim 2, further comprising an additional stage, said additional stage including a loop formed of a single conductor.

4. A ferromagnetic filter as claimed in claim 2, wherein said ferromagnetic filter material is a YIG sphere and said loop comprises multiple conductors all of which are parallel to one another and which are configured to generally follow the contour of the YIG sphere in passing adjacent the sphere, but none of the conductors touch the sphere.

5. A method of eliminating spurious responses in a ferromagnetic resonance device of the type in which a ferromagnetic resonance material, subjected to a magnetic field, is coupled to a coupling loop which does not touch the material, comprising the steps of:

(a) supplying a coupling loop consisting of multiple conductors, and (b) spacing the multiple conductors apart by at least one conductor thickness, but maintaining all said conductors in a substantially parallel relationship with respect to one another.

6. A method of increasing the bandwidth of a ferromagnetic resonance device of the type in which a ferromagnetic resonance material, subjected to a magnetic field, is coupled to a coupling loop, which does not touch the material, comprising the steps of:

(a) supplying a coupling loop consisting of multiple conductors, and spacing the multiple conductors apart by at least one conductor thickness, but maintaining all said conductors in a substantially parallel relationship with respect to one another.

7. A method as claimed in claim 6 further comprising a process for supplying a coupling loop for step (a) of claim 6 with controlled spacing between the conductors, comprising the steps of:

(a) supplying a strip conductor, (b) coating said conductor with photo resist, (c) exposing said coating to define said multiple conductors, and (d) etching said strip with said exposed coating to produce said multiple conductors.

* * * * *